United States Patent [19]

Skalka

[11] 4,252,313

[45] Feb. 24, 1981

[54] PLAYGROUND EQUIPMENT

[75] Inventor: Gerald P. Skalka, Washington, D.C.

[73] Assignee: Victor Stanley, Inc., Dunkirk, Md.

[21] Appl. No.: 31,156

[22] Filed: Apr. 18, 1979

[51] Int. Cl.[3] ..... A63B 9/00

[52] U.S. Cl. ..... 272/113; 272/62; 256/65

[58] Field of Search ..... 272/61, 62, 103–113; 108/137, 153–159; 248/251, 188; 211/86, 105.1, 105.4, 105.5, 105.6, 123; 5/282 R, 286, 290, 292, 296, 299, 303, 304

[56] References Cited

U.S. PATENT DOCUMENTS

| | | | |
|---|---|---|---|
| 2,206,581 | 7/1940 | Shapiro | 272/113 |
| 2,462,321 | 2/1949 | Holmes | 211/105.4 X |
| 3,524,644 | 8/1970 | Kane | 272/62 X |
| 3,814,416 | 6/1974 | Munger et al. | 272/113 X |
| 3,893,776 | 7/1975 | Beattie | 272/113 X |
| 3,969,871 | 7/1976 | Ewers | 272/113 X |
| 4,124,317 | 11/1978 | Dauth | 272/62 X |

FOREIGN PATENT DOCUMENTS

| | | | |
|---|---|---|---|
| 327136 | 10/1920 | Fed. Rep. of Germany | 211/105.4 |
| 73548 | 10/1916 | Switzerland | 211/105.6 |

*Primary Examiner*—Richard J. Apley

[57] ABSTRACT

A type of playground device has vertical or horizontal support members with pipes perpendicular to such wooden support members extending between and mounted on the support members. Each pipe has a sharpened circular edge on each end which extends into a relatively large diameter inner pipe receiving portion of a transverse opening in one of the wooden support members; the sharp edge engages the bottom of the opening with the other side of the wooden support member having a relatively large outer bolt head receiving opening communicating with the inner pipe receiving opening through a central relatively small diameter opening portion. A bolt extends through the opening portions, which are axially aligned, into a threaded plug near the end of the pipe and pulls the sharp end edge of the pipe into the wood of the wooden support member upon tightening of the bolt to provide a construction that is both strong and vandal proof and protrusion free.

11 Claims, 3 Drawing Figures

16
20
22
26
24
18
14
16
22
36
26
34
30
32
24

14
20
30
32
38
18
40
34
36
22
24
26

2
10
12
14
12
14
14
2
12
14
14
14
50
50
50

PLAYGROUND EQUIPMENT

This invention is in the field of playground equipment and is more specifically directed to climbing rung or chinning bar type equipment in which metal rungs are supported by wooden supporting posts or the like.

Playground equipment must be rugged, safe and resistant to vandalism without being overly expensive. A number of different playground devices employ wooden post members providing support for metal pipe rungs for permitting users to climb or otherwise perform physical feats on the rungs. One of the problems with the prior known constructions is that the rungs frequently become loose with the passage of time and the rough usage to which they are subjected. Moreover, it is unfortunate, but true, that playground equipment is subjected to a great amount of vandalism to which many of the presently known devices are easily susceptible.

For example, one type of prior known device employs parallel vertical extending posts between which a metal rod is positioned. The metal rod is supported by virtue of the fact that it extends through aligned openings provided in the wooden post members with one end of the metal rod having a radially extending head flange engageable with the side of the post and the other end of the metal rod being connected to a collar fitted on the rod end and clamped to the rod by means of a set screw extending through the collar to engage the outer surface of the rod. The collar is attached to the adjacent wooden post by means of nails or screws driven through openings in the collar. Similar nails can be driven through the head flange on the other end of the rod and in some versions, collars are employed on both ends of the rod for effecting the connection to the wooden post members. In any event, devices of this type are easily susceptible to vandalism and the pipe eventually becomes loose in its support members so as to provide an unsafe and unsatisfactory condition for proper usage of the device. The susceptibility to vandalism is due largely to the fact that the retaining collars are externally located with respect to the wooden post members. Moreover, the use of external retaining collars of hinge flanges on the pipe members represents a safety hazard in that these protruding portions can injure users of the equipment.

Also, the nature of wood is to shrink and swell and/or warp with changes in moisture content.

Therefore, it is the primary object of this invention to provide a new and improved item of playground equipment.

A further object of the invention is the provision of a new and improved item of playground equipment of the type comprising wooden support members between which metal rungs are connected.

Achievement of the foregoing objects is enabled by the preferred embodiment of the invention in an entirely new and unobvious manner. More specifically, the preferred embodiment comprises the provision of a plurality of vertically or horizontally extending parallel wooden post members between which one or more metal rungs in the form of hollow pipes are mounted. The post members include transverse openings extending through the post members for permitting the mounting of the metal rung members with each transverse opening comprising an innver portion facing and receiving one end of the metal rung, a central portion of smaller diameter than the inner portion but of sufficient diameter to receive the body of a bolt and an outer bolt head receiving portion of sufficient depth to permit the bolt head of a bolt extending through the transverse opening to be fully enclosed in the peripheral confines of the post. The inner end of the bolt is threaded and is received in a threaded transverse plug provided in the end of the metal rung, which is in the form of an elongated hollow pipe. The ends of the metal rung are sharpened and upon tightening of the bolt means, the sharpened end edges are drawn into the wood of the post at the inner extent of the inner opening portion. The frictional engagement of the sharp edges with the wood retains the metal rung in position even if the bolt is subsequently removed. Consequently, the resultant construction is extremely rugged and is not susceptible to destruction by ordinary vandalism. Moreover, the system is economical to fabricate and assemble.

A better understanding of the manner in which the preferred embodiment achieves the objects of the invention will be enabled when the following detailed description is considered in conjunction with the appended drawings in which.

Figure 2:
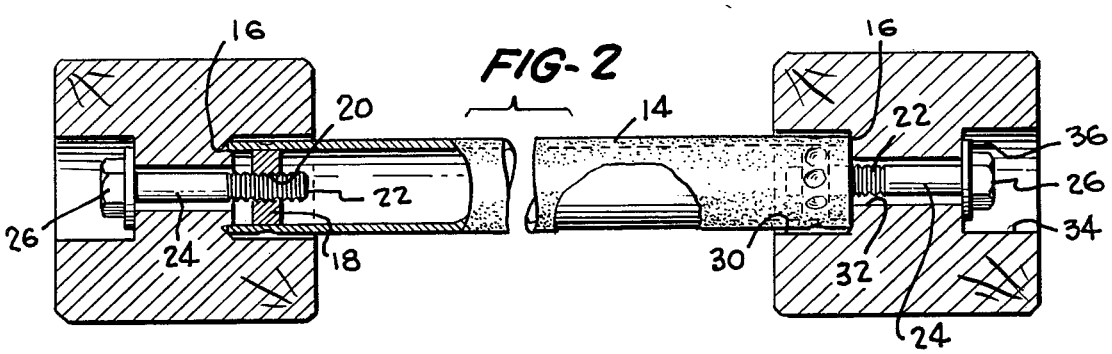
FIG. 2 is a sectional view taken along lines 2—2 of FIG. 1.
Figure 3:
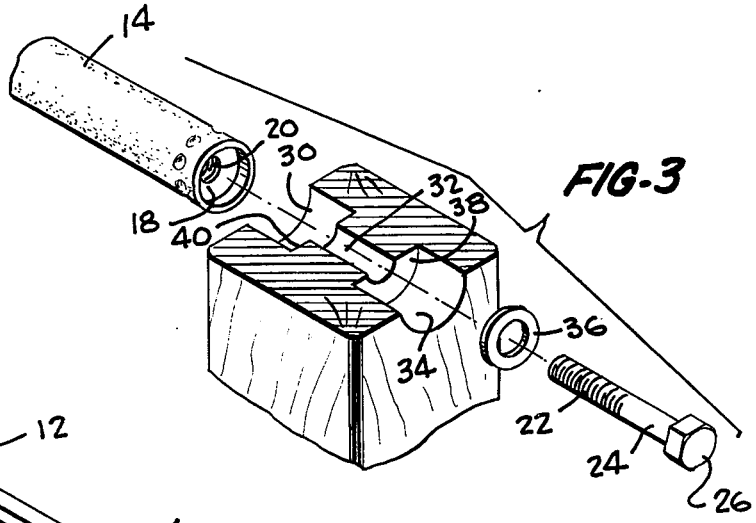
FIG. 3 is an exploded perspective view of the parts illustrated in section in FIG. 2.
Figure 1:
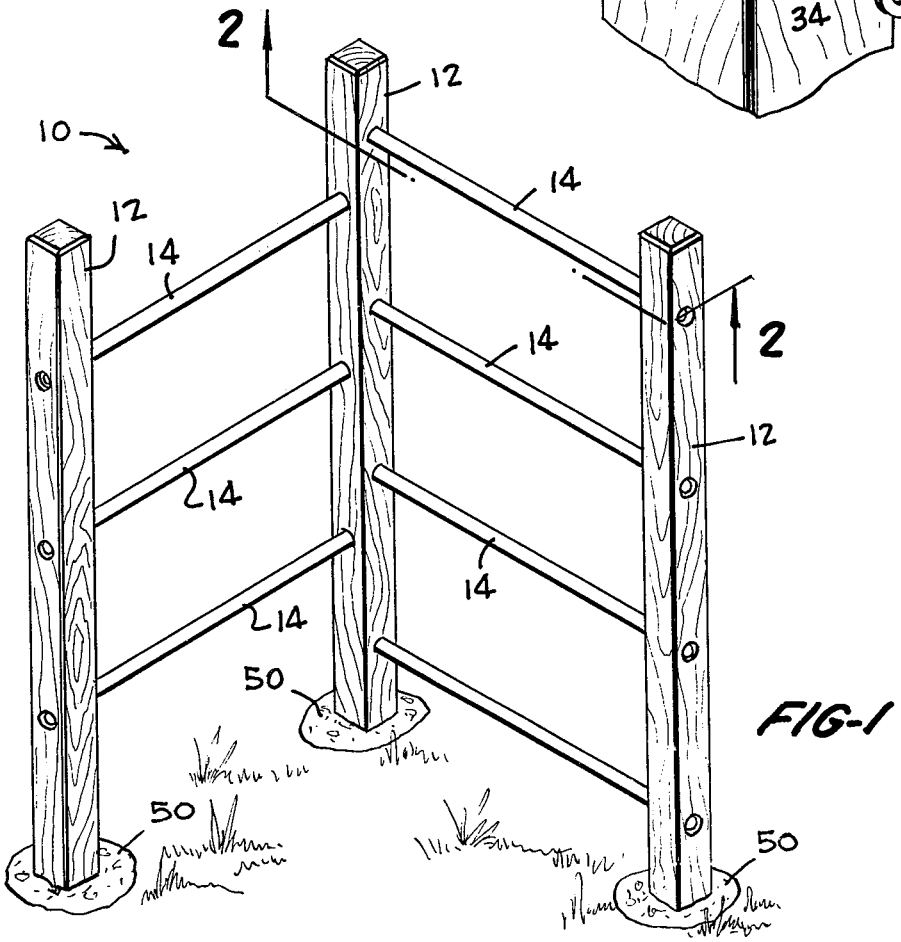
FIG. 1 is a perspective view of the preferred embodiment of the subject invention.

Turning first to FIG. 1, an item of playground equipment, generally designated 10, is disclosed with the item including a plurality of vertically extending wooden post members 12 of square cross-sectional configuration. A plurality of elongated metal rungs 14 are provided between the post members and are attached to and supported by the post members with each of the metal rung members having a textured powder coating having friction enhancing properties. The metal rungs are provided with sharpened edge portions 16 and have transverse metal plugs 18 welded or pressed in their inner bores in a position inwardly of the sharpened end edge portions 16 as best shown in FIG. 2. Additionally, the transverse metal plugs 18 include an axially positioned threaded surface 20 into which the threaded end portion 22 of a bolt is received. As shown in FIG. 3, the bolt includes a body portion 24 and a bolt head 26.

Each of the wooden post members 12 is provided with a transversely extending opening extending completely through the post member as best shown in FIG. 3 with the transverse opening comprising three distinct and important portions consisting of an inner pipe end receiving portion 30 of sufficient diameter to receive the end portion of a rung 14, a central bolt body receiving portion 32 having a diameter less than the diameter of the inner portion 30 and an outer bolt head receiving portion 34 having a diameter greater than the diameter of the central bolt body receiving portion 32. It will be observed that a washer 36 is interposed between the bolt head 26 and the surface 38 defining the inner extent of the outer bolt head receiving portion 34.

The apparatus is assembled by first loosely positioning the parts in the manner illustrated in FIG. 2 following which the bolts are tightened to pull the sharpened end portions 16 into the body of the wood at the surface 40 defining the inner extent of the inner portion of the transverse opening. The pipe is consequently substantially embedded at its outer end in the body of the wood and the frictional engagement of the wood with the pipe surface serves to retain the pipe surface in the wood even if the bolt is subsequently removed. The lower ends of the wooden post members 12 are then embedded in the ground such as by the use of concrete 50 or the like as shown in FIG. 1. The resultant construction is highly resistant to vandalism since it retains is structural integrity even if the bolt is removed; however, the recessed location of the bolt head makes removal of the bolt difficult and essentially impossible without the use of tools.

Thus, a strong and reliable item of playground equipment is provided by the invention and numerous modifications will undoubtedly occur to those of skill in the art; for example, the invention is not limited to usage with vertical post members and could be used for mounting rungs between wooden members oriented in practically any direction; thus, it should be understood that the invention is not limited to the disclosed embodiment and it should be limited solely by the appended claims.

I claim:

1. A vertically extending structure comprising first and second spaced wooden support members, an elongated member extending between and supported by said first and second wooden support members, said elongated member having at least one end configured to penetrate its wooden support member, each of said wooden support members in axial alignment with said elongated member, said transverse openings each including an inwardly facing portion of a size and shape to matingly receive and to envelop in a supporting fashion one end of said elongated member, a central bolt body receiving portion having a transverse dimension less than that of said inwardly facing portion, and an outer bolt head receiving portion having a greater transverse diameter than said central bolt body receiving portion and bolt means extending through said transverse opening having a threaded end threadably engaged with internal thread means in the end of said elongated member so that tightening of said bolt means pulls said one end of said elongated member into the wood to penetrate the wood of said wooden support member at the innermost extend of said inwardly facing portion of said transverse opening to tend to prevent the removal of said elongated member from said inwardly facing portions if said bolt means is removed.

2. The invention of claim 1 wherein said elongated member is a metal pipe.

3. The invention of claim 1 wherein said elongated member is a metal pipe and wherein said bolt head receiving portion is of sufficient depth to fully enclose the head of said bolt within the peripheral confines of said wooden support member.

4. The invention of claim 1 wherein said bolt head receiving portion is of sufficient depth to fully enclose the bolt head of said bolt within the peripheral confines of said wooden support member.

5. The invention of claim 1 wherein said elongated member is a metal pipe extending in a horizontal manner and having a friction enhancing outer coating.

6. The invention of claim 1 wherein said elongated member is a hollow metal pipe and said internal thread means is provided in plug members spaced inwardly in said pipe from the said one end thereof.

7. The invention of claim 6 wherein said metal pipe is of cylindrical configuration.

8. The invention of claim 1 wherein a plurality of said elongated members are mounted between said wooden support members with each of said elongated members comprising a metal tube.

9. The invention of claim 8 wherein said wooden support members comprise vertical posts and said metal tubes are horizontally oriented.

10. A vertically extending structure comprising first and second spaced wooden support members, an elongated metal tube extending between and supported by said first and second wooden support members, said elongated metal member having at least one end of a configuration to penetrate its wooden support member, each of said wooden support members including a transverse opening extending through the wooden support members in axial alignment with said elongated member, said transverse openings each including an inwardly facing portion of a size and shape to matingly receive and to envelop in a supporting fashion one end of said elongated member and a central bolt body receiving portion adjacent said inwardly facing portion having a transverse dimension less than that of said inwardly facing portion, and bolt means extending through said transverse opening having a threaded end threadably engaged with internal thread means in the end of said elongated metal tube member so that tightening of said bolt means pulls said one end of said elongated member into the wood to penetrate the wood of said wooden support member at the innermost extent of said inwardly facing portion of said transverse opening to tend to prevent the removal of said elongated member from said inwardly facing portions if said bolt means is removed.

11. The invention of claim 10 wherein said elongated metal tube is of a cylindrical configuration and a thickness selected to deform its said one end to prevent turning of the elongated metal tube in its wooden support member upon the tightening of said bolt means.

* * * * *